US006026274A

United States Patent [19]

Aslam et al.

[11] Patent Number: 6,026,274

[45] Date of Patent: Feb. 15, 2000

[54] COLLAPSIBLE READILY REPLACEABLE BELT FUSER ASSEMBLY

[75] Inventors: Muhammed Aslam, Rochester; Socrates Hryhorenko, Sodus; Robert D. Bobo, Ontario, all of N.Y.

[73] Assignee: Eastman Kodak Company, Rochester, N.Y.

[21] Appl. No.: 08/992,059

[22] Filed: Dec. 17, 1997

[51] Int. Cl.[7] ..... G03G 15/20

[52] U.S. Cl. ..... 399/329; 399/107

[58] Field of Search ..... 399/67, 24, 122, 399/125, 110, 107, 320, 328, 329, 162, 165, 116; 430/124, 99; 347/154, 156

[56] References Cited

U.S. PATENT DOCUMENTS

| | | | |
|---|---|---|---|
| 4,739,371 | 4/1988 | Ray et al. | 399/116 |
| 5,157,447 | 10/1992 | Farnand et al. | 430/99 X |
| 5,164,782 | 11/1992 | Nagayama et al. | 399/320 |
| 5,243,384 | 9/1993 | Everdyke et al. | 399/116 |
| 5,256,507 | 10/1993 | Aslam et al. | 430/42 |
| 5,257,071 | 10/1993 | Hediger | 399/165 |
| 5,321,480 | 6/1994 | Merle et al. | 399/329 |
| 5,400,121 | 3/1995 | Foote | 399/116 |

*Primary Examiner*—Sandra Brase
*Assistant Examiner*—Sophia S. Chen
*Attorney, Agent, or Firm*—Lawrence P. Kessler

[57] ABSTRACT

A belt fusing apparatus for use in a reproduction apparatus where a colorant image is formed on a receiver member, and the colorant image is fixed on the receiver member by the belt fusing apparatus for providing image gloss to such colorant image. The belt fusing apparatus includes a fuser assembly and a pressure roller operative associated with the fuser assembly. The fuser assembly includes a fuser roller, a mechanism for supporting the fuser roller, a steering roller, and a mechanism for supporting the steering roller. A member pivotably interconnects the fuser roller support mechanism and the steering roller support mechanism so that the fuser roller support mechanism can move relative to the steering roller support mechanism to and from operative an association therebetween and a collapsed position to facilitate accessibility, serviceability, and ready replacement of a fusing belt adapted to be entrained about the fuser roller and the steering roller for movement in a predetermined direction about a closed loop path.

10 Claims, 4 Drawing Sheets

COLLAPSIBLE READILY REPLACEABLE BELT FUSER ASSEMBLY

CROSS REFERENCE TO RELATED APPLICATIONS

U.S. patent appl. Ser. No. 08/992,872, filed Dec. 17, 1997, entitled "REPRODUCTION APPARATUS PROVIDING SELECTABLE IMAGE QUALITY AND GLOSS" in the name of Muhammed Aslam et al.

U.S. patent appl. Ser. No. 08/992,057, filed Dec. 17, 1997, entitled "BELT FUSING ACCESSORY WITH SELECTABLE FUSED IMAGE GLOSS" in the name of Muhammed Aslam et al.

U.S. patent appl. Ser. No. 08/992,643, filed Dec. 17, 1997, entitled "BELT FUSER APPARATUS FOR PREVENTING LINE ART TYPE MARKING PARTICLE OFFSET" in the name of Muhammed Aslam et al.

U.S. patent appl. Ser. No. 08/992,058, filed Dec. 17, 1997, entitled "APPLICATION OF CLEAR TONER DEVELOPED NEGATIVE TO THE IMAGE IN AN ELECTROPHOTOGRAPHIC PROCESS TO ELIMINATE IMAGE RELIEF AND DIFFERENTIAL GLOSS ARTIFACTS" in the name of William J. Staudenmayer et al.

U.S. patent appl. Ser. No. 08/992,746, filed Dec. 17, 1997, entitled "APPLICATION OF CLEAR MARKING PARTICLES TO IMAGES WHERE THE MARKING PARTICLE COVERAGE IS UNIFORMLY DECREASED TOWARDS THE EDGES OF THE RECEIVER MEMBER" in the name of Muhammed Aslam et al.

U.S. patent appl. Ser. No. 08/992,060, filed Dec. 17, 1997, entitled "COOLING AND REUSING THE HEAT TO PREHEAT THE FUSING WEB IN A BELT FUSER" in the name of Muhammed Aslam et al.

U.S. patent appl. Ser. No. 08/992,056, filed Dec. 17, 1997, entitled "MECHANISM FOR TRACKING THE BELT OF A BELT FUSER" in the name of Muhammed Aslam et al.

U.S. patent appl. Ser. No. 08/992,745, filed Dec. 17, 1997, entitled "APPARATUS FOR PACKAGING AND INSTALLATION OF A FUSING BELT" in the name of Muhammed Aslam et al.

FIELD OF THE INVENTION

This invention is directed in general to a fusing apparatus for a reproduction apparatus, and more particularly to a belt fusing apparatus for a reproduction apparatus, such belt fusing apparatus being collapsible for accessibility, serviceability, and ready fusing belt replacement.

BACKGROUND OF THE INVENTION

Typical commercial reproduction apparatus include electrostatographic process copier/duplicators or printers, inkjet printers, and thermal printers. With such reproduction apparatus, pigmented marking particles, ink, or dye material (hereinafter referred to commonly as marking particles) are utilized to develop an image, of information to be reproduced, on a dielectric support member for transfer to a receiver member, or directly onto a receiver member. The receiver member bearing the marking particle image is transported through a fuser device where the image is fixed (fused) to the receiver member, for example, by heat and pressure to form a permanent reproduction thereon. While the fuser device is typically integral with the reproduction apparatus, it may also be an independent piece of equipment, generally referred to as an off line fuser. Off line fusers, being a device devoted to a single task, have the ability to be optimized to perform the fusing function.

Certain reproduction apparatus have been designed to produce multi-color copies. In such reproduction apparatus, multiple color separation images are respectfully developed with complimentary colored marking particles, in superposition on a receiver member. It has been found that fixing of multi-color marking particle images to a receiver member requires substantially different operating parameters than fixing standard black marking particle images to a receiver member. Moreover, the respective operating parameters may in fact be in contradistinction. That is, multi-color images require a high degree of glossiness for a full, rich depth of color reproduction; on the other hand, since glossiness for black marking particle images may significantly impair legibility, a matte finish is preferred.

It is known that the glossiness of a marking particle image is, at least in part, dependent upon the marking particle melting characteristics in the fixing process. In general, the fixing apparatus serves to soften or at least partially melt the marking particles, enabling the marking particles to permeate into the fibers of the receiver member so that the marking particles are fixed to the receiver member to give a glossy image reproduction. For example, the fixing apparatus may include a heated roller which contacts the marking particles and the receiver member. With multi-color marking particle images, the multiple color marking particle images are respectively melted and fixed by the heated roller. If the color marking particle images are not sufficiently melted, light scattering cavities may occur in the copy which degrades the color reproduction. Moreover, if the marking particles on the receiver member do not have a mirror-like surface, incident light is reflected by diffusion from the marking particle surface and is not admitted into the marking particle layers, making the colors on the receiver member appear dark and cloudy. Therefore, low melting point marking particles are used. They yield few cavities and a hard flat surface so as to give glossy and vivid colors in the reproduction.

Low melting point marking particles are subject to increased image offset to the heating roller. This can produce undesirable defects in the reproduction or subsequent reproductions. Although image offset can be reduced by application of fuser oil to the heating roller, the use of such oil introduces further complications into the fusing system, such as handling of the oil and making sure that the layer of oil on the roller is uniform for uniform heat application. Alternatively, a mechanical arrangement for reducing image offset, without the need for fuser oil, has been found. Such mechanical arrangement, as shown for example in U.S. Pat. No. 5,256,507 (issued Oct. 26, 1993, in the name of Aslam et al), provides an elongated web which is heated to melt the marking particles and then cooled to cool the particles and facilitate ready separation of the receiver member with the marking particle image fixed thereto from the elongated web. The nature of operation of the elongated web arrangement also serves to increase the glossiness of the fixed marking particle image. As a result, such arrangement is particularly useful for multi-color image fusing. It is, of course, important to provide for accurate control of the tracking of the elongated web for the belt fusing apparatus.

SUMMARY OF THE INVENTION

In view of the above, this invention is directed to a reproduction apparatus where a colorant image is formed on a receiver member, and the colorant image is fixed on the receiver member by a belt fusing apparatus for providing image gloss to such colorant image. The belt fusing apparatus includes a fuser assembly and a pressure roller operative associated with the fuser assembly. The fuser assembly includes a fuser roller, a mechanism for supporting the fuser roller, a steering roller, and a mechanism for supporting the steering roller. A member pivotably interconnects the fuser roller support mechanism and the steering roller support mechanism so that the fuser roller support mechanism can move relative to the steering roller support mechanism to and from operative an association therebetween and a collapsed position to facilitate accessibility, serviceability, and ready replacement of a fusing belt adapted to be entrained about the fuser roller and the steering roller for movement in a predetermined direction about a closed loop path.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
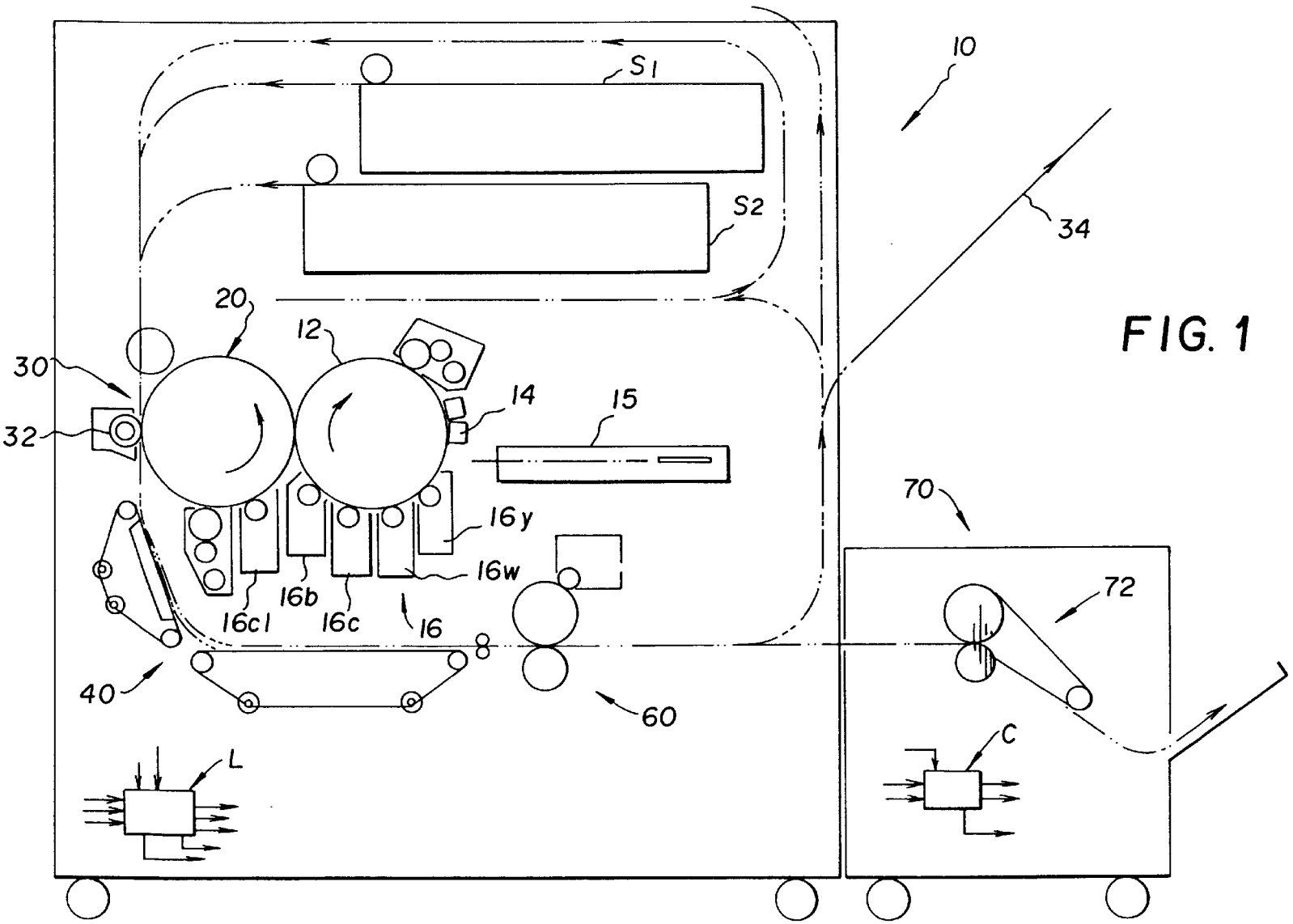
FIG. 1 is a front elevational view of an electrostatographic reproduction apparatus including a belt fusing apparatus utilizing a collapsible belt fuser assembly according to this invention.

Referring now to the accompanying drawings, an electrostatographic reproduction apparatus, designated generally by the numeral 10, is shown in FIG. 1. While the reproduction apparatus 10 is shown as an electrophotographic type reproduction apparatus, it is readily appreciated that the belt fusing accessory according to this invention is suitable for use with other types of reproduction apparatus, such as ink jet printers and thermal printers.

The reproduction apparatus 10 includes a primary image forming dielectric member, for example, a drum 12 having a photoconductive surface, upon which a pigmented marking particle image, or series of different color marking particle images, is formed. In order to form images, when the photoconductive drum 12 is rotated in the direction of the arrow associated therewith, the photoconductive surface of drum is uniformly charged by a charger 14, and then exposed imagewise by, for example, a laser 15 or light emitting diode (LED) array, to create a corresponding latent electrostatic image. The latent electrostatic image is developed by a application of pigmented marking particles to the image bearing drum 12 by a development station 16. In the embodiment of the reproduction apparatus 10 as shown, there are five developing units, each unit having particular different color marking particles associated respectively therewith. Specifically, developing unit 16*y* contains yellow marking particles, developing unit 16*m* contains magenta marking particles, developing unit 16*c* contains cyan marking particles, and developing unit 16*b* contains black marking particles. Of course, other color marking particles (e.g. red, green, blue, etc.) may be used in the particular developing units depending upon the overall arrangement of the development station 16 and operational characteristics of the color development scheme for the reproduction apparatus 10. Additionally, a developing unit 16*cl* is provided, containing clear marking particles, which is utilized to aid in improving the quality and gloss of reproduced images, in the manner more fully described in the copending U.S. patent app. Ser. No. 08/992,872, filed on even date herewith.

Each developer unit is separately activated for operative developing relation with drum 12 to apply different color marking particles respectively to a series of images carried on drum 12 to create a series of different color marking particle images. The developed marking particle image is transferred (or multiple marking particle images are transferred one after another in registration) to the outer surface of a secondary or intermediate image transfer member, for example, an intermediate transfer drum 20. Thereafter, the single marking particle image, or a multicolor image comprising multiple marking particle images respectively formed on the surface of the intermediate image transfer member drum 20, is transferred in a single step to a receiver member.

The receiver member is transported along a path (designated by chain-link lines) into a nip 30 between intermediate image transfer member drum 20 and a transfer backing member, for example a roller 32. The receiver member is delivered from a suitable receiver member supply (hopper $S_1$ or $S_2$) into nip 30 where it receives the marking particle image. The receiving member exits the nip 30, and is transported by transport mechanism 40 to a fuser assembly where the marking particle image is tacked to the receiver member by application of heat and/or pressure. After tacking the image to the receiver member, the receiver member is selectively transported to return to the transfer nip 30 to have a second side (duplex) image transferred to such receiver member, to a remote output tray 34 for operator retrieval, or to an output accessory such as the belt fusing accessory, according to this invention, designated generally by the numeral 60.

Appropriate sensors (not shown) of any well known type, such as mechanical, electrical, or optical for example, are utilized in the reproduction apparatus 10 to provide control signals for the apparatus. Such sensors are located along the receiver member travel path and are associated with the primary image forming member photoconductive drum 12, the intermediate image transfer member drum 20, the transfer backing member roller 32, and various image processing stations. As such, the sensors detect the location of a receiver member in its travel path, and the position of the primary image forming member photoconductive drum 12 in relation to the image forming processing stations, and respectively produce appropriate signals indicative thereof. Such signals are fed as input information to a logic and control unit L including a microprocessor, for example. Based on such signals and a suitable program for the microprocessor, the unit L produces signals to control the timing operation of the various electrographic process stations for carrying out the reproduction process. The production of a program for a number of commercially available microprocessors, which are suitable for use with the invention, is a conventional skill well understood in the art. The particular details of any such program would, of course, depend on the architecture of the designated microprocessor.

The belt fusing apparatus 60, according to this invention, is shown as being integral with the reproduction apparatus 10. The belt fusing apparatus 60 includes an input transport for delivering marking particle image-bearing receiver members to a fusing assembly, designated generally by the numeral 62. The fusing assembly 62 comprises a fusing belt 64 entrained about a heated fusing roller 66 and a steering roller 68, for movement in a predetermined direction about a closed loop path. The fusing belt 64 is, for example, a thin metallic or heat resistant plastic belt. Metal belts can be electroformed nickel, stainless steel, aluminum, copper or other such metals, with the belt thickness being about 2 to 5 mils. Seamless plastic belts can be formed of materials such as polyimide, polypropylene, or the like, with the belt thickness summarily being about 2 to 5 mils. Usually these fusing belts are coated with thin hard coatings of release material such as silicone resins, fluoropolymers, or the like. The coatings are typically thin (1 to 10 microns), very smooth, and shiny. Such fusing belts could also be made with some textured surface to produce images of lower gloss or texture.

A pressure roller 70 is located in nip relation with the heated fusing roller 66. A flow of air is directed at the area of the belt run upstream of the steering roller 68 and adjacent to the steering roller to cool such area. The cooling action provides for a commensurate cooling of a receiver member, bearing a marking particle image, while such member is in contact with the fusing belt 64. The cooling action for the receiver member serves as the mechanism to substantially prevent offset of the marking particle image to the pressure roller.

Figure 2:
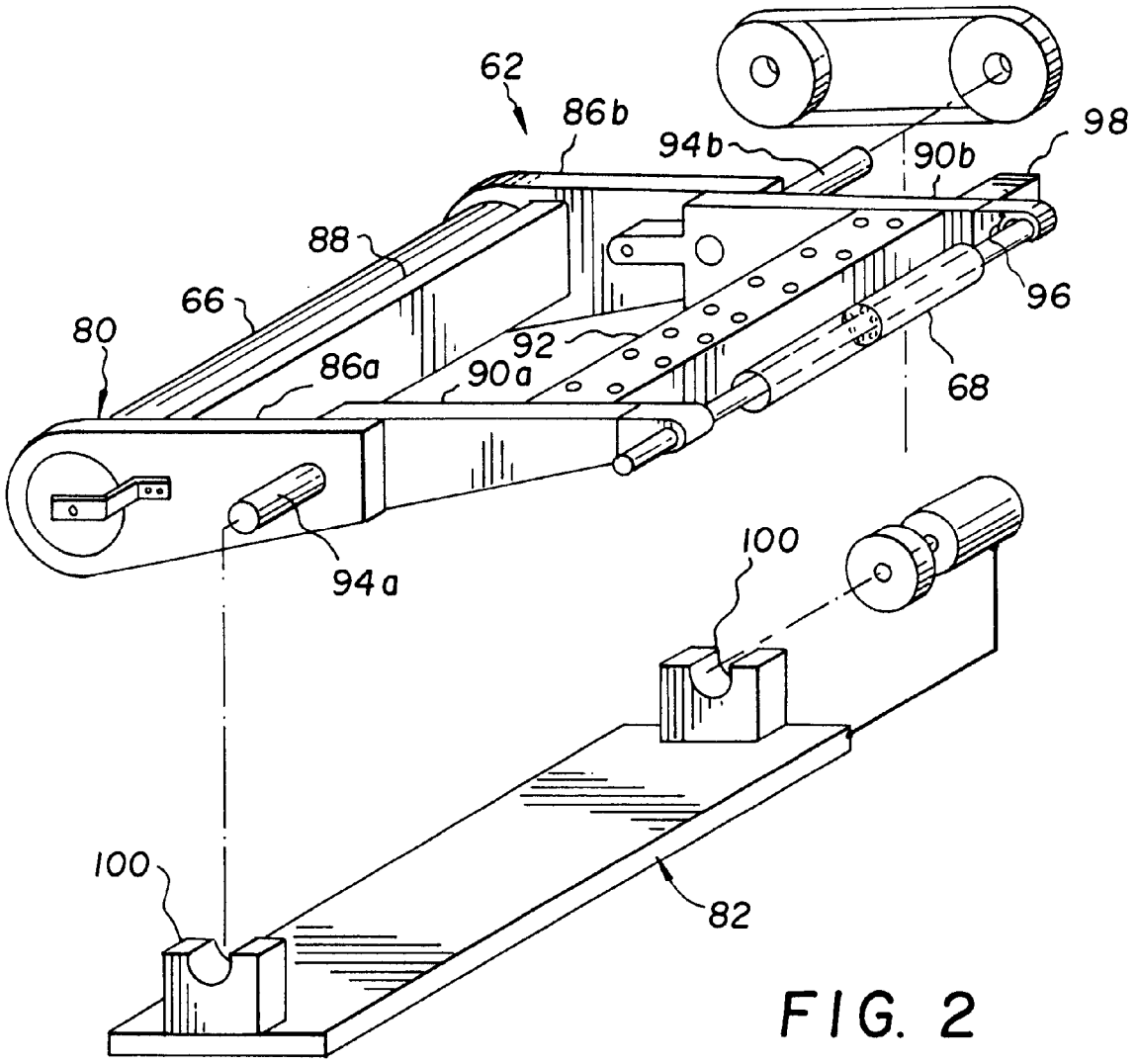
FIG. 2 is a partially exploded view, in perspective and on an enlarged scale, of a portion of the belt fusing apparatus with the collapsible belt fuser assembly according to this invention.
Figure 3:
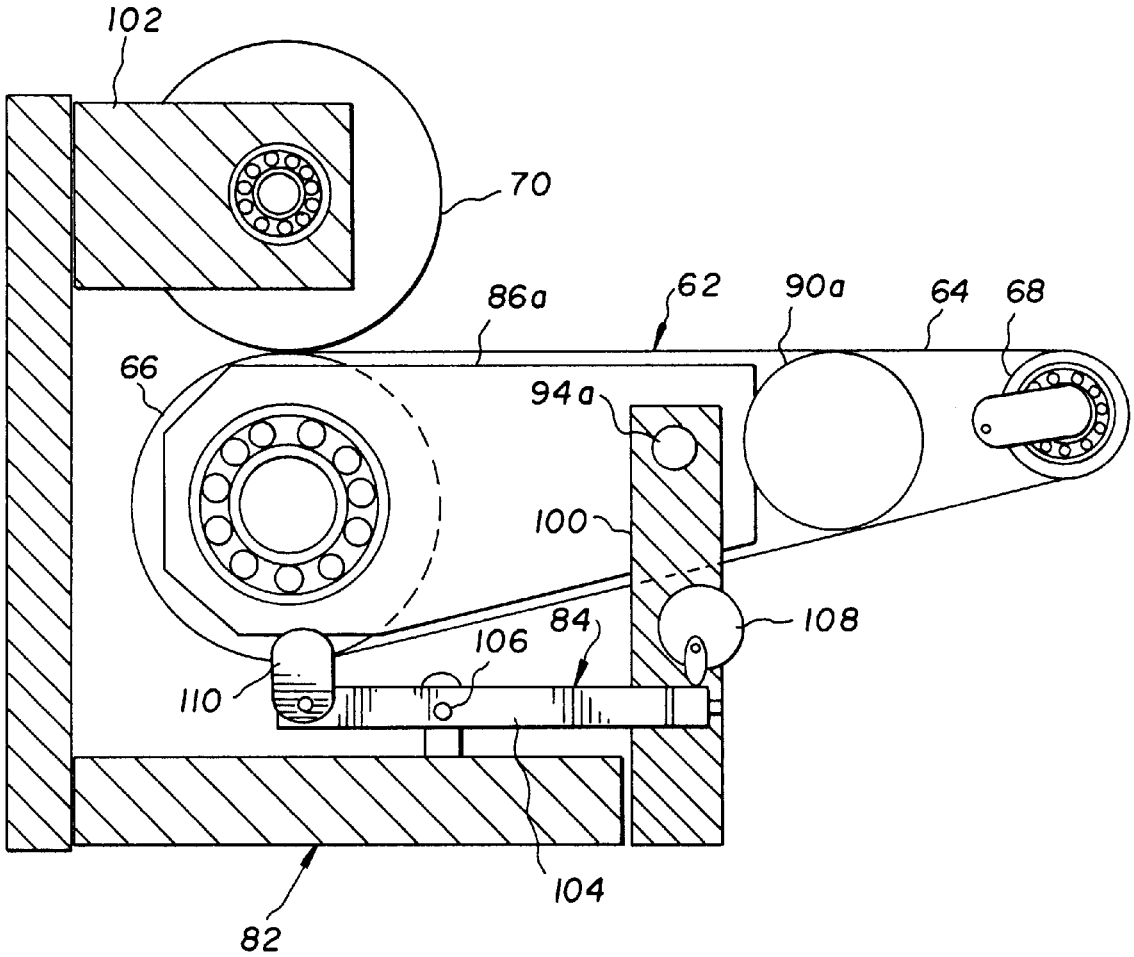
FIG. 3 is a front elevational view, on an enlarged scale, of a portion of the belt fusing apparatus with the collapsible belt fuser assembly according to this invention.

According to this invention, the belt fuser assembly 62, as best shown in the FIGS. 2 and 3, is of collapsible construction for accessibility, serviceability, and ready replacement of the fusing belt 64. The belt fuser assembly 62 includes a fuser belt support frame 80 adapted to be mounted on a machine frame 82 (an integral part of the reproduction apparatus 10) and pressure mechanism 84 (see FIG. 3). The support frame 80 includes a pair of fuser roller support arms 86*a*, 86*b*, connected by a brace 88. The brace 88 may also serve as a heat shield for the fuser roller 66. The support frame 80 further includes a pair of steering roller support arms 90*a*, 90*b*, connected by a brace 92. The brace 92 may also serve as the cooling air flow housing. A spring mechanism 96 and a steering actuator 98, of any suitable construction, are associated with the pair of arms 90*a*, 90*b* to respectively urge the steering roller 68 in a direction to maintain a desired tension on the fusing belt 64 and caster and gimbal the steering roller for accurate tracking of the fusing belt.

The pair of arms 86*a*, 86*b* and the pair of arms 90*a*, 90*b* are pivotably mounted on a pair of pivot shafts 94*a*, 94*b*, respectively. The pivot shafts 94*a*, 94*b* are respectively carried in blocks 100 of the frame 82. The blocks 100 serve to locate the fuser assembly 62 such that the pressure mechanism 84 urges the fuser roller 66 into operative association with the pressure roller 70 (carried by a bracket 102 of the frame 82). The pressure mechanism 84 includes a lever 104 mounted on a pivot axis 106. A pressure actuator cam 108 engages the lever 104 adjacent to an end thereof, and a pressure applicator 110 is fixed to the lever adjacent to the opposite end thereof. The pressure applicator 110 engages the pair of arms 86*a*, 86*b* to urge the fuser roller into appropriate pressure engagement with the pressure roller 70 depending on the orientation of the pressure actuator cam 108.

Figure 4:
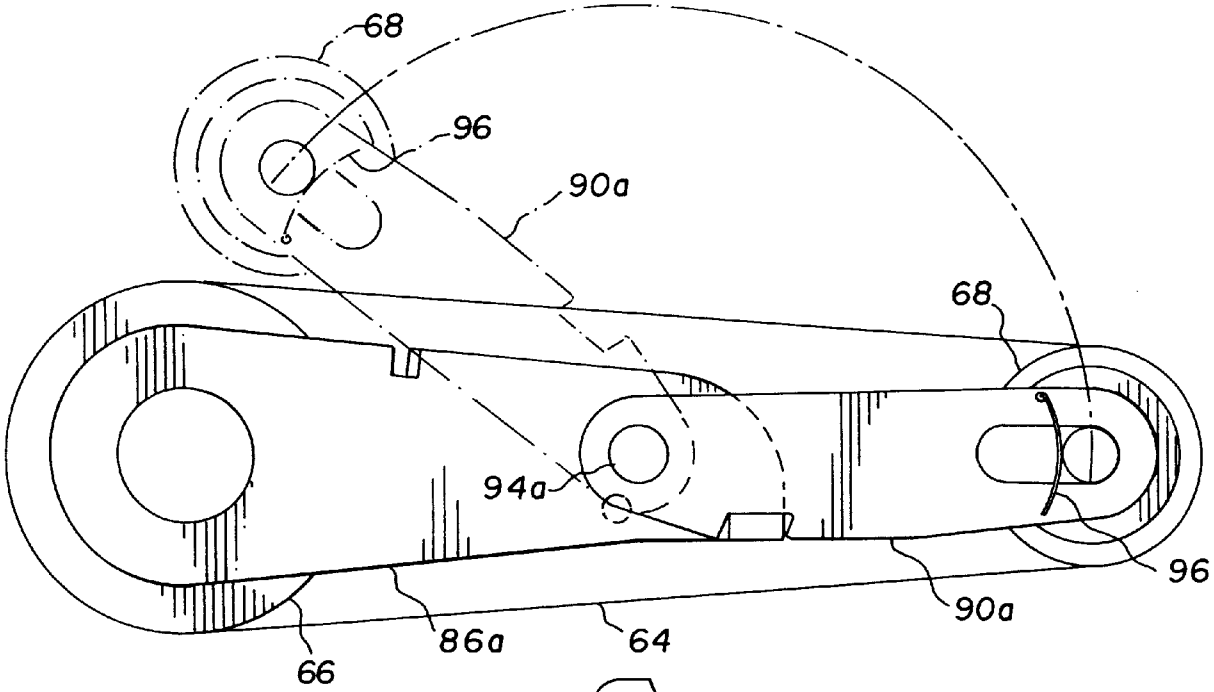
FIG. 4 is a front elevational view, on an enlarged scale, of the collapsible belt fuser assembly according to this invention, showing the belt fuser assembly in the operative position and in the collapsed position.
Figure 5:
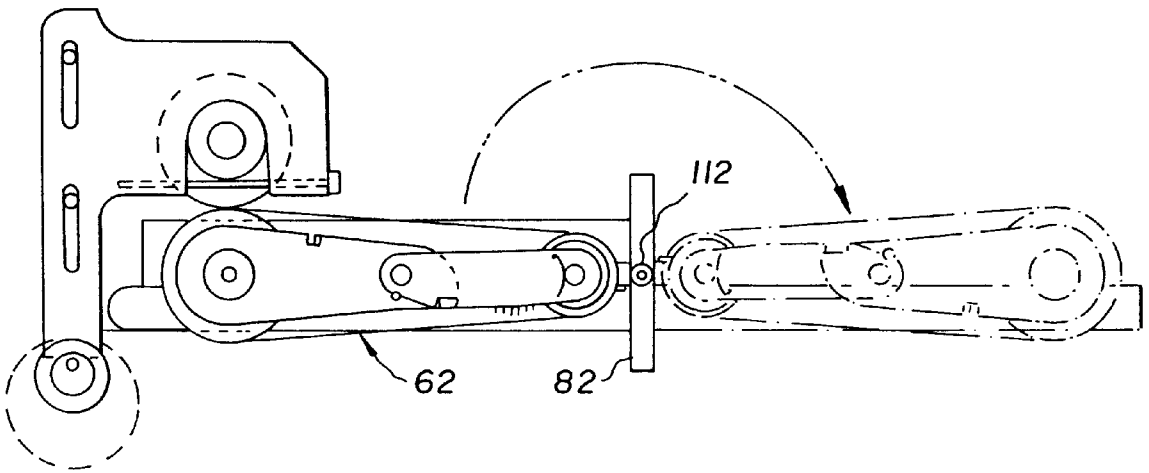
FIG. 5 is a front elevational view, on an enlarged scale, of a portion of the belt fusing apparatus with the collapsible belt fuser assembly, according to this invention, in the operative position and in a position readily accessible for serviceability or replacement.

The pivot shafts 94*a*, 94*b* also serve to enable the pair of fuser roller support arms 86*a*, 86*b* to pivot relative to the pair of steering roller support arms 90*a*, 90*b* (see FIG. 4). This will, in effect, collapse the fusing assembly 62, from the solid line position to the phantom line position, to provide for accessibility and serviceability, and enable ready replacement of the fuser belt 64. Of course, the entire fusing assembly 62 could be mounted on rails (not shown) in any well known manner, so as to be slideable out of the reproduction apparatus to an exterior location. This will further provide for the accessibility and serviceability of the fuser assembly 62, and facilitate the replacement of the fuser assembly as a complete unit or just replacement of the fusing belt 64. Alternatively, the fuser assembly 62 could be pivotably supported on the support frame 82, as at pivot pin 112 (see FIG. 5). As such, the fuser assembly can swing about the pivot pin 112, from the solid line position to the phantom line position, to facilitate the replacement of the replacement of the fusing belt 64, or provide ready access to the fuser assembly for service.

The invention has been described in detail with particular reference to certain preferred embodiments thereof, but it will be understood that variations and modifications can be effected within the spirit and scope of the invention.

What is claimed is:

1. In a reproduction apparatus where a colorant image is formed on a receiver member, and said colorant image is fixed on said receiver member by a belt fusing apparatus for providing image gloss to such colorant image, said belt fusing apparatus including a fuser assembly and a pressure roller operative associated with said fuser assembly, said fuser assembly comprising:

a fuser roller;

a first pair of arms supporting said fuser roller, said first pair of arms being spaced apart by a first brace member, said first brace member serving as a heat shield;

a steering roller;

a second pair of arms supporting said steering roller, said second pair of arms spaced apart by a second brace member, said second brace member serving as a cooling air flow housing; and a member for pivotably interconnecting said first pair of spaced arms and said second pair of spaced arms so that said fuser roller can move relative to said steering roller to and from an operative association therebetween and a collapsed position to facilitate accessibility, serviceability, and ready replacement of a fusing belt adapted to be entrained about said fuser roller and said steering roller for movement in a predetermined direction about a closed loop path.

2. The fuser assembly of claim 1 wherein said second pair of spaced arms includes means for urging said steering roller in a direction to maintain a desired tension on said fusing belt.

3. The fuser assembly of claim 1 wherein said second pair of spaced arms includes means for steering said steering roller to provide for tracking of said fusing belt.

4. The fuser assembly of claim 1 wherein said second pair of spaced arms includes means for urging said steering roller in a direction to maintain a desired tension on said fusing belt, and means for steering said steering roller to provide for tracking of said fusing belt.

5. The fuser assembly of claim 1 wherein said member for pivotably interconnecting said first pair of spaced arms and said second pair of spaced arms includes a pair of pivot pins connected to said first pair of spaced arms and said second pair of spaced arms respectively.

6. The fuser assembly of claim 5 wherein said pair of pivot pins is supported in a frame of the belt fusing apparatus.

7. The fuser assembly of claim 6 including means for urging said fuser roller into operative association with the pressure roller of the belt fusing apparatus.

8. The fuser assembly of claim 7 wherein said urging means includes a cam actuator mechanism.

9. The fuser assembly of claim 8 wherein said cam actuator mechanism includes a lever pivotably supported on said frame, a pressure actuator cam engageable with said lever adjacent to an end thereof, and a pressure applicator fixed to said lever, adjacent to the opposite end thereof, and engageable with said fuser roller support means to urge said fuser roller into appropriate pressure engagement with said pressure roller.

10. The fuser assembly of claim 1 including a pivot pin for supporting said fuser assembly adjacent to one end thereof for pivotable movement about said pivot pin to further facilitate accessibility, serviceability, and ready replacement of a fusing belt.

* * * * *